US009054441B2

(12) United States Patent
Kimura et al.

(10) Patent No.: US 9,054,441 B2
(45) Date of Patent: Jun. 9, 2015

(54) CONNECTOR

(71) Applicants: Japan Aviation Electronics Industry, Limited, Tokyo (JP); JAE Taiwan, Ltd., Taichung (TW)

(72) Inventors: Masaki Kimura, Tokyo (JP); Koji Kawase, Taichung (TW)

(73) Assignees: Japan Aviation Electronics Industry, Limited, Tokyo (JP); JAE Taiwan, Ltd., Taichung (TW)

( * ) Notice: Subject to any disclaimer, the term of this patent is extended or adjusted under 35 U.S.C. 154(b) by 58 days.

(21) Appl. No.: 13/729,104

(22) Filed: Dec. 28, 2012

(65) Prior Publication Data

US 2013/0273780 A1 Oct. 17, 2013

(30) Foreign Application Priority Data

Apr. 16, 2012 (JP) ..... 2012-092896

(51) Int. Cl.

| | |
|---|---|
| ***H01R 24/00*** | (2011.01) |
| ***H01R 13/514*** | (2006.01) |
| ***H01R 13/41*** | (2006.01) |
| *H01R 12/71* | (2011.01) |

(52) U.S. Cl.

CPC ..... *H01R 13/514* (2013.01); *H01R 12/716* (2013.01); *H01R 13/41* (2013.01)

(58) Field of Classification Search

CPC ..... H01R 13/514; H01R 13/41; H01R 12/712

USPC ..... 439/634, 630, 752

See application file for complete search history.

(56) References Cited

U.S. PATENT DOCUMENTS

| | | | | |
|---|---|---|---|---|
| 5,057,028 | A * | 10/1991 | Lemke et al. | 439/101 |
| 5,199,880 | A * | 4/1993 | Arai | 439/65 |
| 6,431,889 | B1 * | 8/2002 | Olson | 439/157 |
| 6,808,398 | B2 * | 10/2004 | Fan | 439/79 |
| 2009/0017701 | A1 * | 1/2009 | Ma | 439/752 |

FOREIGN PATENT DOCUMENTS

JP 11-329594 11/1999

OTHER PUBLICATIONS

Chinese Office Action in CN 201310077607.5, issued Dec. 23, 2014.

* cited by examiner

*Primary Examiner* — Felix O Figueroa
(74) *Attorney, Agent, or Firm* — Collard & Roe, P.C.

(57) ABSTRACT

A connector has contacts, a housing holding the contacts, and a holder member fixed to the housing and is adapted to be fitted with a mating connector along a predetermined fitting direction. The housing has a first lateral portion on a side fitted with the mating connector and a second lateral portion on the other side opposite thereto. Each of the contacts has contact press-fit portions press-fitted into the housing from the side of a second lateral portion. The holder member has a restricting portion which is arranged adjacent to the contact on the side of the second lateral portion in the fitting direction and which restricts movement of the contact toward the second lateral portion.

10 Claims, 17 Drawing Sheets

CONNECTOR

This application is based upon and claims the benefit of priority from Japanese Patent Application No. 2012-092896, filed on Apr. 16, 2012, the disclosure of which is incorporated herein in its entirety by reference.

TECHNICAL FIELD

This invention relates to a connector.

BACKGROUND OF THE INVENTION

As a conventional connector, a connector 101 is known which has a plurality of contacts 110 and a housing 120 holding the contacts 110 and which is adapted to be fitted with a mating connector (not shown) along a predetermined fitting direction X, as shown in FIG. 17 (see, for example, JP-A-H11-329594 (Patent Document 1)).

In the connector 101 disclosed in Patent Document 1, the housing 120 has a first lateral portion 121 on a side fitted with the mating connector (not shown) and a second lateral portion 122 on the other side opposite to the first lateral portion 121 in the fitting direction X. Each of the contacts 110 has a contact press-fit portion 117 adapted to be press-fitted into the housing 120 from the side of the second lateral portion 122.

SUMMARY OF THE INVENTION

The connector 101 in Patent Document 1 adopts a structure in which each contact 110 is held by press-fitting the contact press-fit portion 117 of the contact 110 into the housing 120 from the side of the second lateral portion 122 along the fitting direction X. With the above-mentioned structure, upon fitting the connector 101 with the mating connector (not shown), a force is exerted from the mating connector (not shown) toward the second lateral portion 122 and acts on the contact 110. The force is received by a press-fit part R between the housing 120 and the contact 110.

In a case where the connector 101 is reduced in size, it is difficult to ensure a sufficiently large size of the press-fit part R between the contact 110 and the housing 120. Therefore, a sufficient contact holding force exerted by the housing 120 can not be ensured. By repetition of connection and disconnection between the connector 101 and the mating connector (not shown), the contact 110 is repeatedly moved with respect to the housing 120 due to the force exerted from the mating connector (not shown). As a consequence, the press-fit part R between the contact 110 and the housing 120 is gradually loosened so that undesired disengagement or misalignment of the contact 110 may possibly be caused to occur.

The present invention has been made in order to solve the above-described problem in the conventional connector. It is an object of the present invention to provide a connector which has a simple structure and which is capable of preventing undesired disengagement or misalignment of a contact, even when the connector is reduced in size.

According to an exemplary aspect of the present invention, there is provided a connector which comprising at least one contact, a housing holding the contact, and a holder member fixed to the housing and which is adapted to be fitted with a mating connector along a predetermined fitting direction, wherein the housing has a first lateral portion on a side to be fitted with the mating connector and a second lateral portion on the other side opposite to the first lateral portion in the fitting direction, wherein the contact has a contact press-fit portion press-fitted into the housing from the side of the second lateral portion, wherein the holder member has a restricting portion arranged adjacent to the contact on the side of the second lateral portion in the fitting direction and which is adapted to restrict the contact from moving toward the second lateral portion.

A plurality of the contacts may be arranged at a predetermined pitch along a longitudinal direction of the housing, and the holder member may be provided in common to all or a part of the contacts arranged along the longitudinal direction of the housing.

The connector may comprise a first contact row and a second contact row, the first contact row and the second contact row may comprise a plurality of the contacts arranged at a predetermined pitch along a longitudinal direction of the housing, respectively, the first contact row and the second contact row may be spaced apart from each other in a third direction perpendicular to the longitudinal direction of the housing and the fitting direction, and the holder member may be provided in common to the first contact row and the second contact row.

The connector may further comprise a metal plate arranged inside the housing and having a plate terminal portion for external connection, and the holder member may be formed of an insulating material and has a through hole allowing the plate terminal portion to be inserted therethrough.

The plate terminal portion may have a plate press-fit portion press-fitted into the through hole of the holder member.

The connector may further comprise a metal plate arranged inside the housing and having a plate terminal portion for external connection, and the metal plate may have a holding portion for holding the holder member.

The metal plate may be inserted into the housing from the side of the first lateral portion or the side of the second lateral portion and mounted to the housing in a state where movement of the metal plate at least in an insertion direction of the metal plate is restricted by the housing, and the plate terminal portion may be protruding toward the second lateral portion and to the outside of the housing.

The metal plate may be press-fitted into the housing.

The holder member may have a holder press-fit portion press-fitted into the housing from the side of the second lateral portion.

A plurality of the contacts may be arranged at a predetermined pitch along a longitudinal direction of the housing, each of the contacts may have a contacting portion, a contact terminal portion for external connection, a second extending portion connected to the contact terminal portion and extending along a third direction perpendicular to the longitudinal direction of the housing and the fitting direction, a first extending portion formed between the contacting portion and the second extending portion and extending along the fitting direction, and the contact press-fit portion formed at the first extending portion, and the restricting portion of the holder member may be arranged adjacent to the first extending portion on the side of the second lateral portion.

The contact may further have a crank portion formed between the first extending portion and the second extending portion, the crank portion may comprise a first portion connected to the first extending portion and extending toward the contact terminal portion and a second portion extending from the first portion toward the second lateral portion of the housing and connecting the first portion and the second extending portion, and the restricting portion of the holder member may be arranged adjacent to the first portion of the crank portion on the side of the second lateral portion.

The contact may be a signal contact, and the connector may further comprise a power supply contact and a shell covering at least a part of the housing.

Effect of the Invention

In the present invention, the holder member is provided which has a restricting portion adapted to restrict or control movement of the contact toward the second lateral portion. With this structure, the movement of the contact with respect to the housing is restricted so as to prevent loosening at a press-fit part between the contact and the housing. Therefore, even when a sufficiently large size of the press-fit part between the contact and the housing is not ensured following reduction in size of the connector, undesired disengagement or misalignment of the contact can be prevented with a simple structure.

DESCRIPTION OF THE EMBODIMENTS

Figure 1:
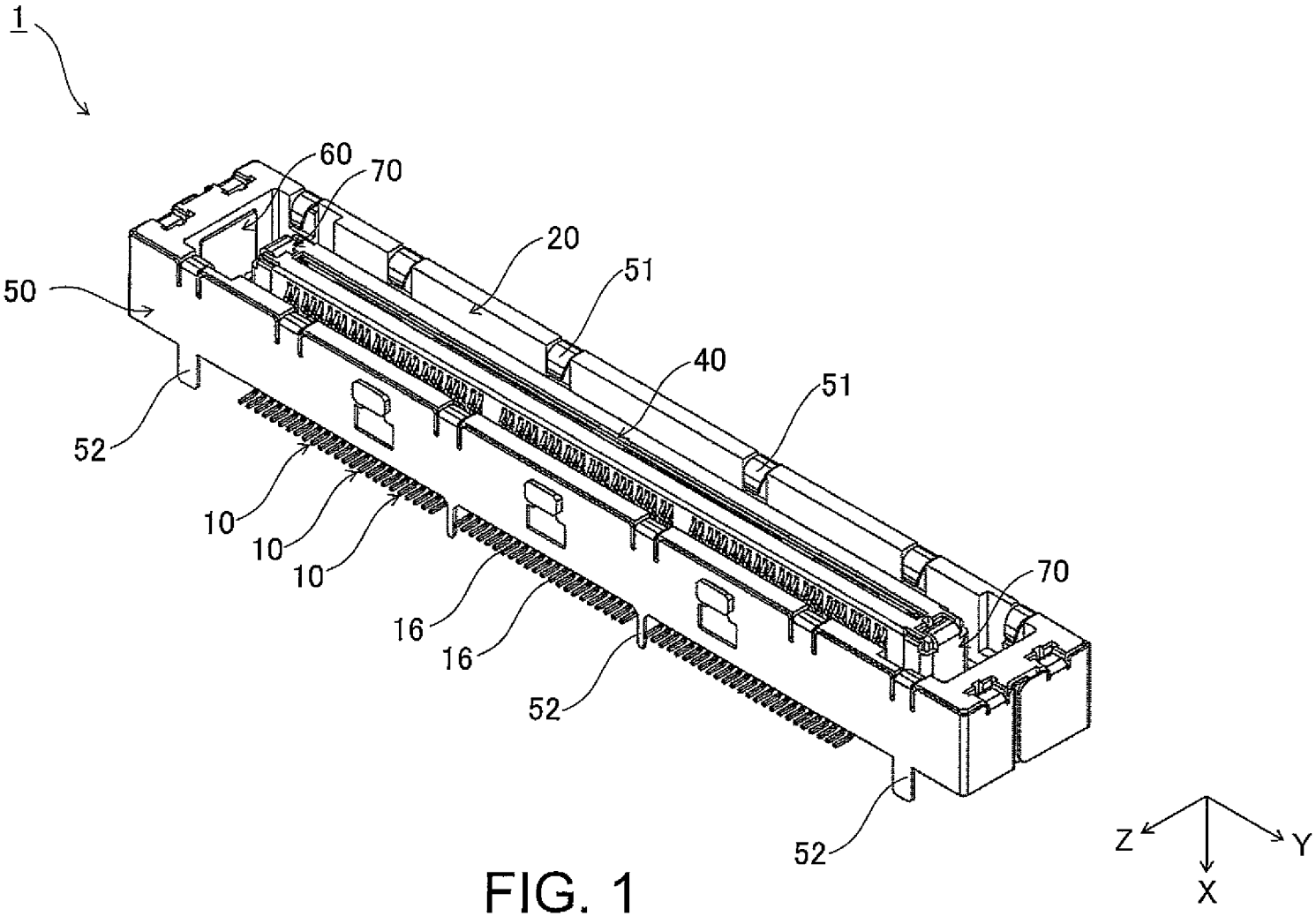
FIG. 1 is a perspective view showing a connector according to an embodiment of the present invention.

Now, a connector according to an embodiment of the present invention and a plurality of modifications will be described with reference to the drawing.

In the following description, a first direction X is defined as a fitting direction between the connector and a mating connector. A second direction Y is defined as a direction which is perpendicular to the first direction X and in which a plurality of contacts are arranged in parallel with one another with respect to a housing. A third direction Z is defined as a direction perpendicular to the first direction X and the second direction Y.

Embodiment

A connector 1 according to an embodiment of the present invention is constructed as a docking connector which is adapted to be mounted to a substrate (not shown) of a docking station for a personal digital assistant, such as a notebook or laptop computer, a slate computer, and a tablet terminal, and which is adapted to be fitted with and connected to a mating connector 80 mounted to the personal digital assistant. Herein, as a feature of the docking connector, the docking connector is required to have a sufficient mechanical strength since the connector is frequently connected to and disconnected from the mating connector 80 and is subjected to a great physical load from the personal digital assistant having the mating connector 80 mounted thereto. It is noted here that, a specific embodiment and application of the connector 1 are not limited to the docking connector.

Figure 2:
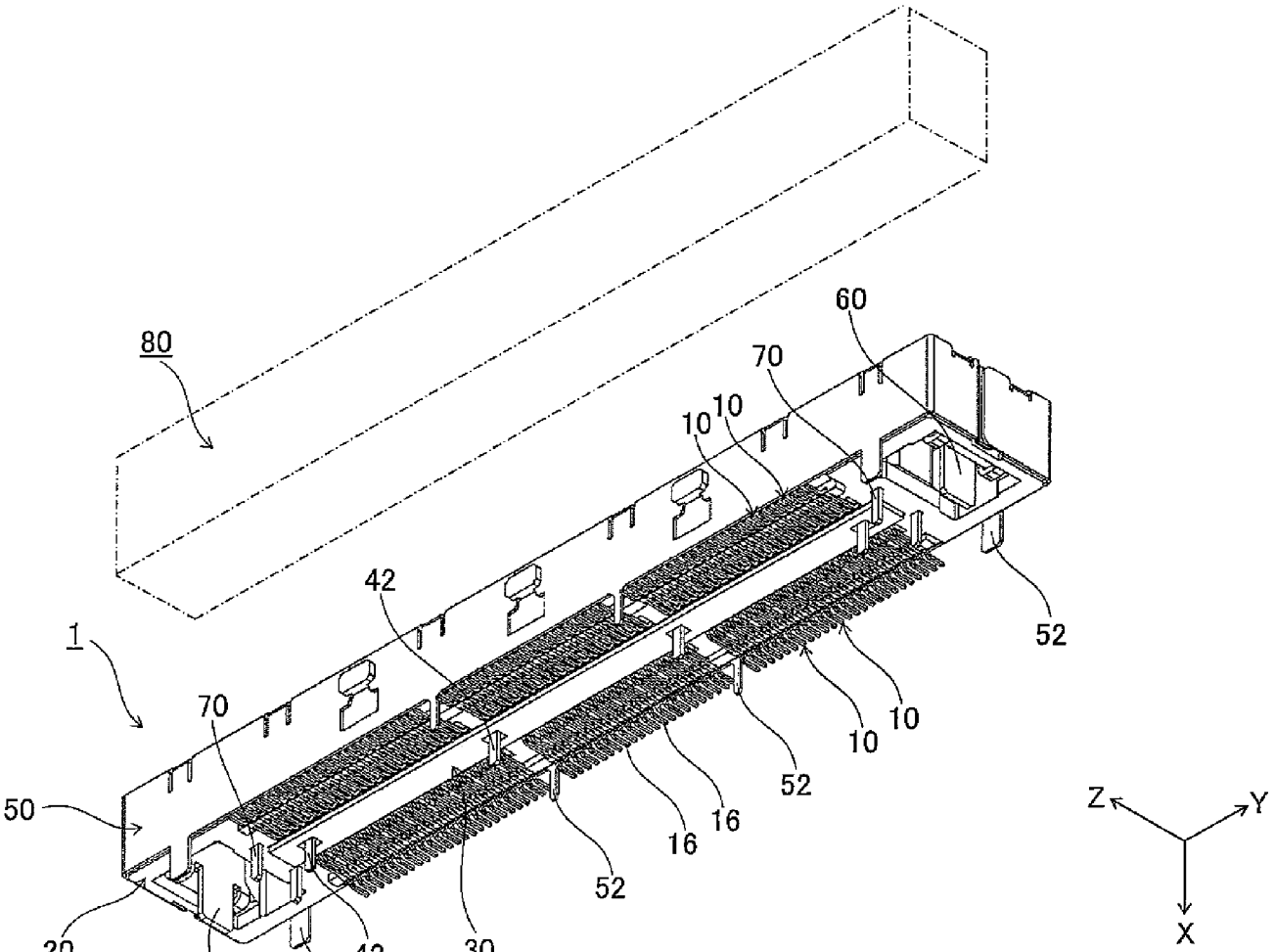
FIG. 2 is a perspective view showing the connector as seen from a view point different from that of FIG. 1.

The connector 1 is constructed as a so-called socket connector and has, as shown in FIGS. 1 and 2, a plurality of contacts 10, a housing 20, a holder member 30, a metal plate 40, a shell 50, a plurality of first power supply contacts 60, and a plurality of second power supply contacts 70. The connector 1 may be constructed as a so-called plug connector.

Figure 3:
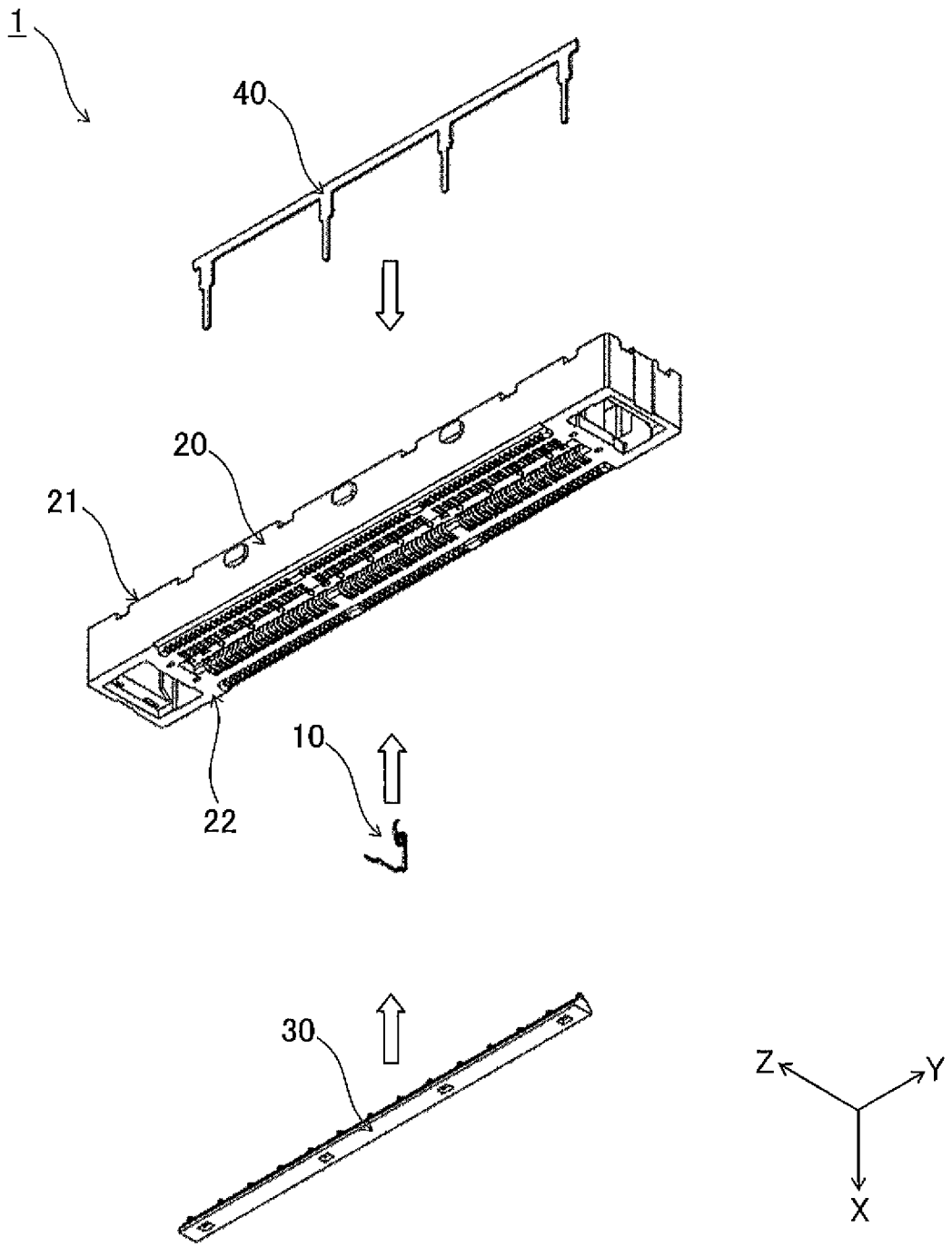
FIG. 3 is an exploded perspective view showing the connector in FIG. 1 in a disassembled state.

Each of the contacts 10 is a signal contact formed of conductive metal. As shown in FIG. 2, on both sides of the housing 20 in the third direction Z, a plurality of the contacts 10 are arranged in parallel with one another at a predetermined pitch in the second direction Y, respectively. The contacts 10 are fixed to the housing 20 from the side of a second lateral portion 22 as shown in FIG. 3.

Figure 4:
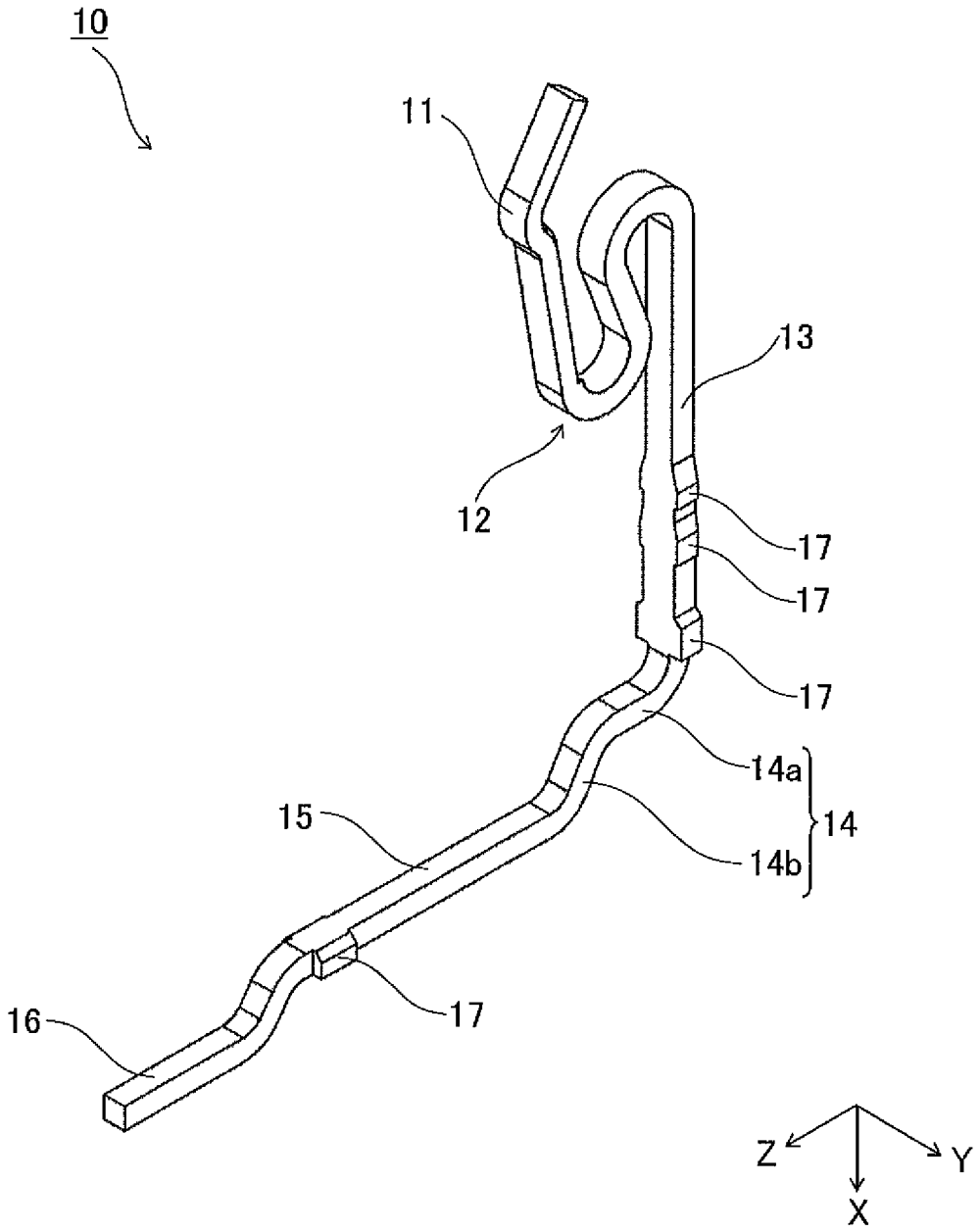
FIG. 4 is a perspective view showing a contact.
Figure 10:
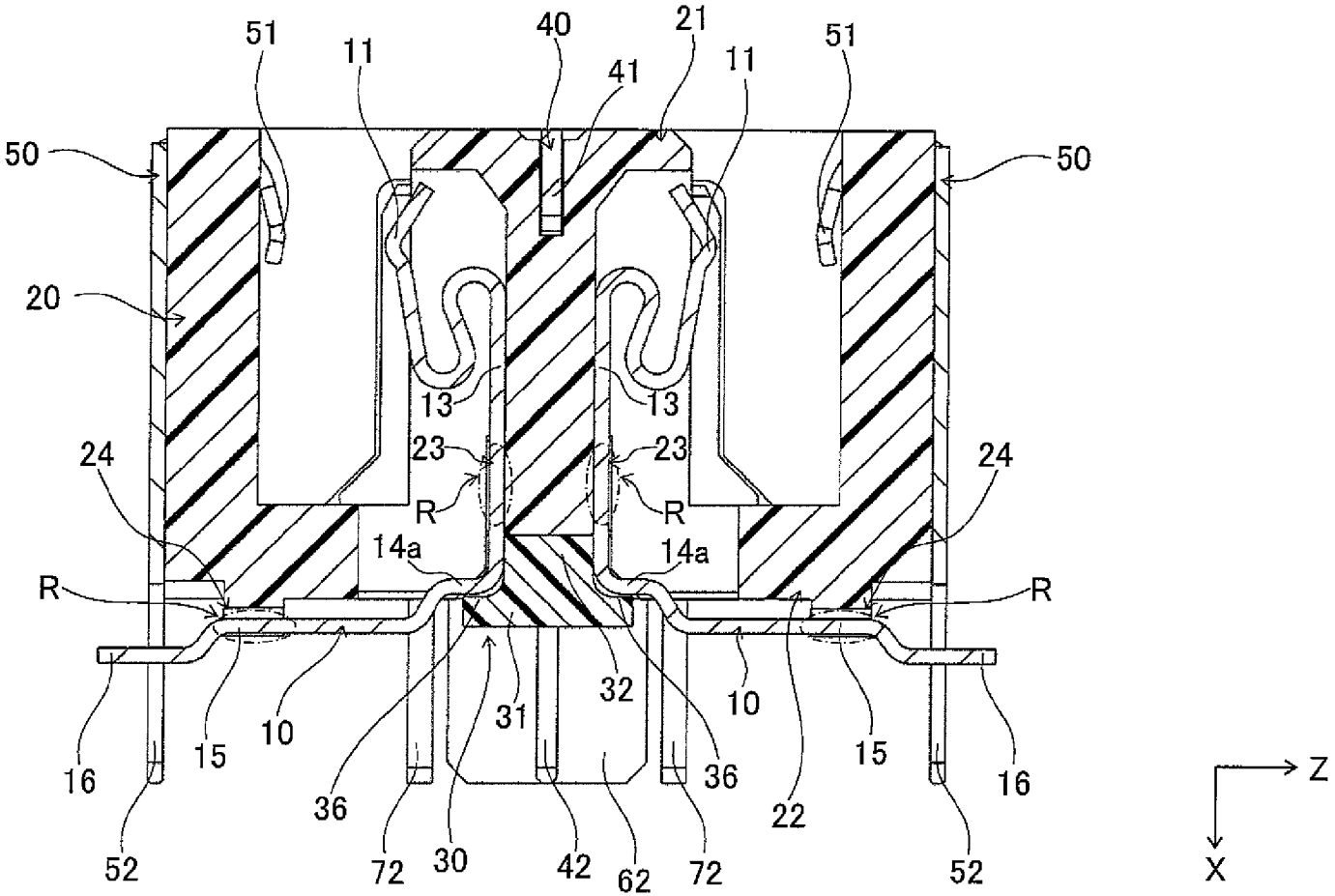
FIG. 10 is a sectional view, taken along a line B-B in FIG. 8, as seen in a direction depicted by arrows.

As shown in FIGS. 4 and 10, each of the contacts 10 has a contact contacting portion 11 which is arranged on the side of a first lateral portion 21 and which is adapted to be brought into contact with a mating contact (not shown), a spring portion 12 which is connected to the contact contacting portion 11 and which is elastically deformable, a first extending portion 13 extending from one end of the spring portion 12 toward the second lateral portion 22 along the first direction X, a crank portion 14 connected to one end of the first extending portion 13, a second extending portion 15 connected to one end of the crank portion 14 and extending along the third direction Z, and a contact terminal portion 16 connected to one end of the second extending portion 15 and adapted to be connected to a substrate (not shown).

The first extending portion 13 and the second extending portion 15 have contact press-fit portions 17 protruding in the second direction Y, as shown in FIG. 4. The contact press-fit portions 17 are press-fitted into the housing 20 from the side of the second lateral portion 22. In FIGS. 9, 10, and 12 to 14, press-fit parts between the contacts 10 and the housing 20 are indicated by a reference symbol R.

As shown in FIG. 4, the crank portion 14 comprises a first portion 14*a* extending from the one end of the first extending portion 13 along the third direction Z and a second portion 14*b* extending from one end of the first portion 14*a* toward the second lateral portion 22 and connecting the first portion 14*a* and the second extending portion 15.

The contact 10 is restricted from moving toward the second lateral portion 22 by a restricting portion 36 of the holder member 30. The restricting portion 36 is disposed adjacent to the first portion 14*a* of the crank portion 14 on the side of the second lateral portion 22, as shown in FIG. 10.

Figure 13:
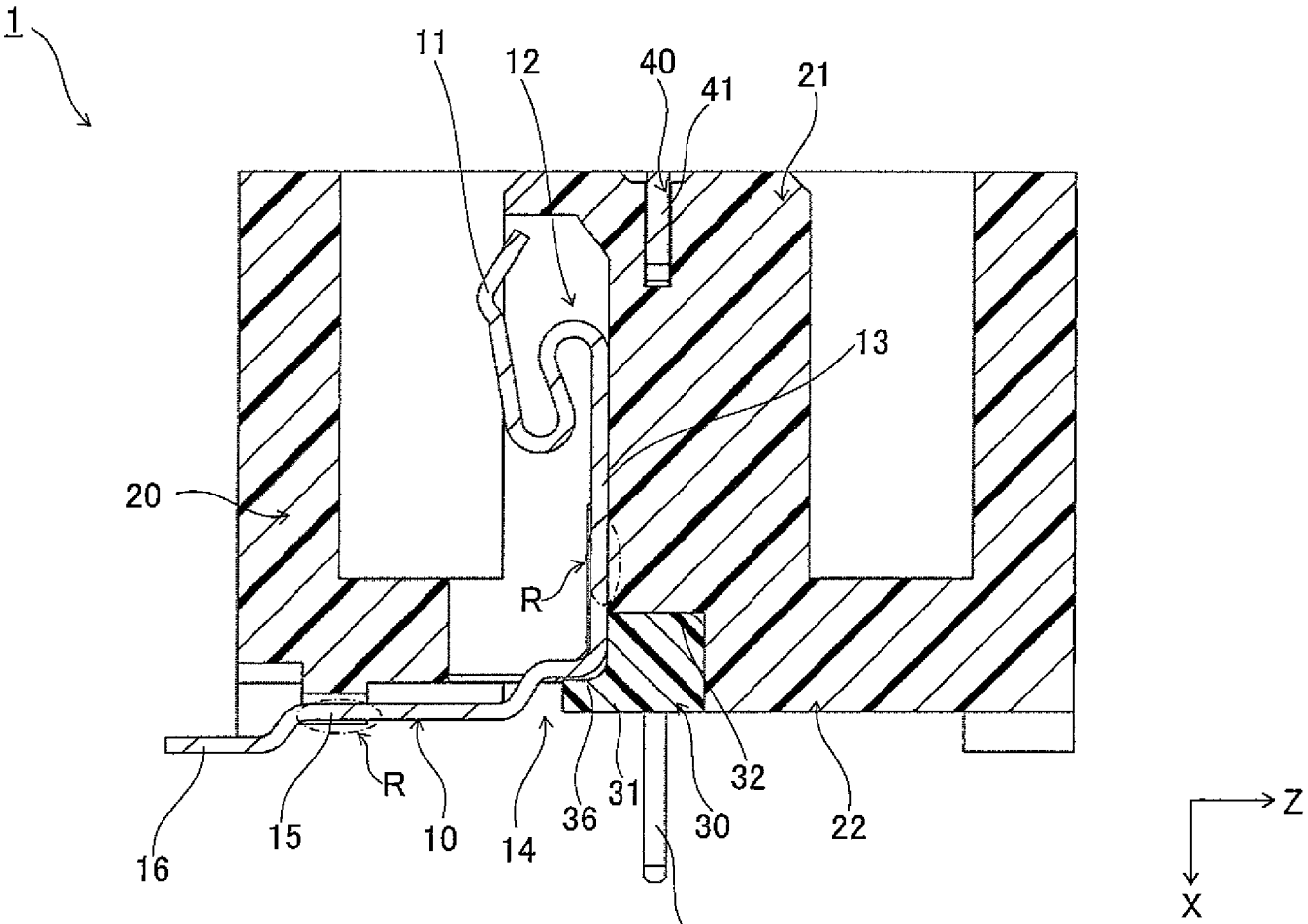
FIG. 13 is a sectional view showing a further modification of the mounting state shown in FIG. 12.

In the example shown in FIG. 10, the contacts 10 are arranged in two rows on the both sides of the housing 20 in the third direction Z. Alternatively, as a modification shown in FIG. 12, the contacts 10 may be arranged in a single row on one side of the housing 20 in the third direction Z. Also in the modification shown in FIG. 12, a plurality of the contacts 10 are arranged in parallel at a predetermined pitch in the second direction Y. In the example shown in FIG. 12, the metal plate 40 is not provided. However, also in the example in which the contacts 10 are arranged in a single row, the metal plate 40 may be provided as shown in FIG. 13. Furthermore, the number of rows of the contacts 10 may be any number, such as 3 or 4.

Figure 14:
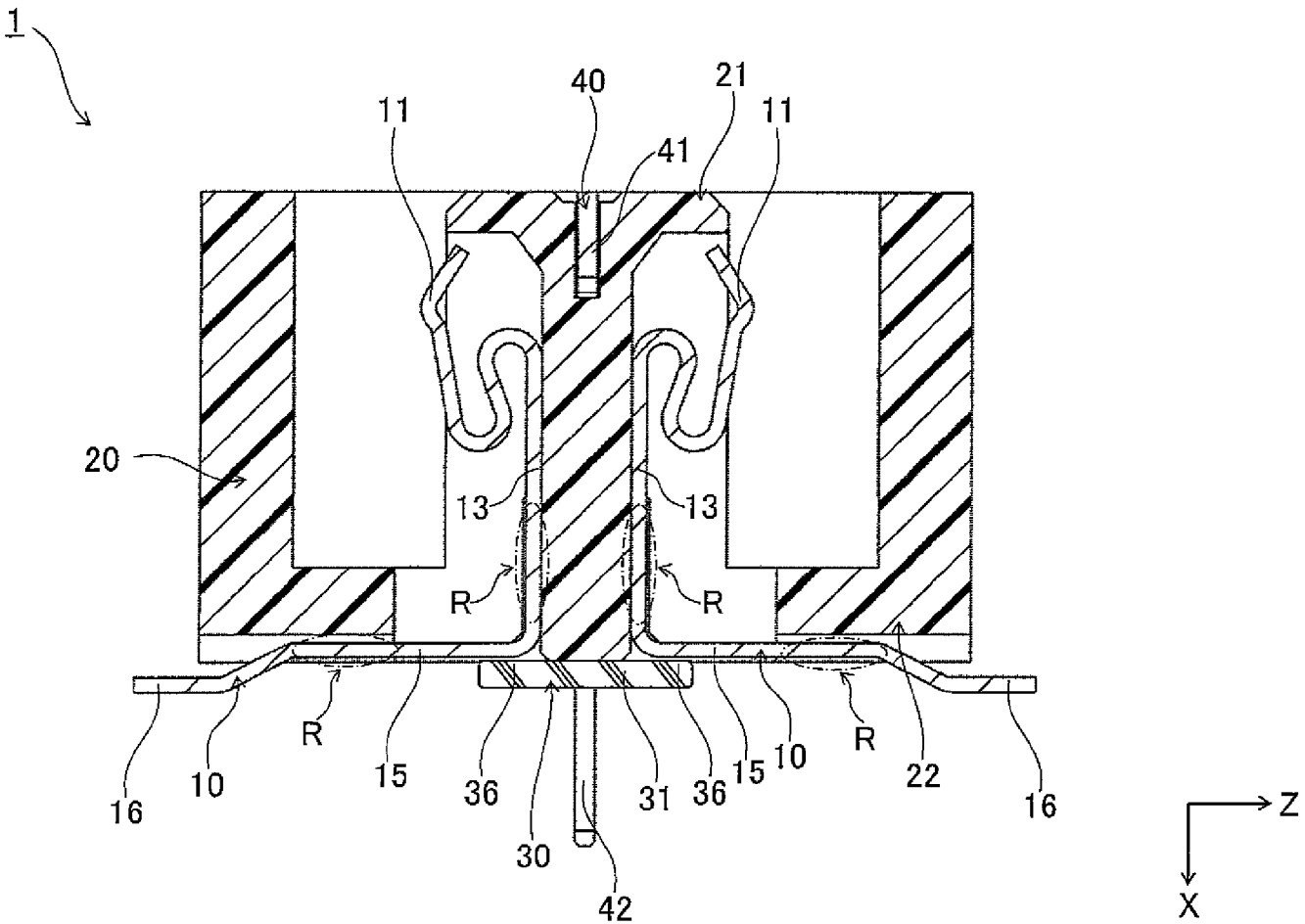
FIG. 14 is a sectional view showing a modification of the holder member.

Further, as a modification shown in FIG. 14, the crank portion 14 may not be formed. In this case, the restricting portion 36 of the holder member 30 is arranged adjacent to the second extending portion 15 on the side of the second lateral portion 22. Comparing the example shown in FIG. 10 provided with the crank portion 14 and the example shown in FIG. 14 without the crank portion 14, the example shown in FIG. 10 is more preferable. This is because, in the example shown in FIG. 10, without increasing a height of the contact terminal portion 16 in the first direction X, it is possible to ensure a sufficiently large thickness of a first holder portion 31 of the holder member 30 in the first direction X, thereby ensuring a strength of the first holder portion 31.

Figure 5:
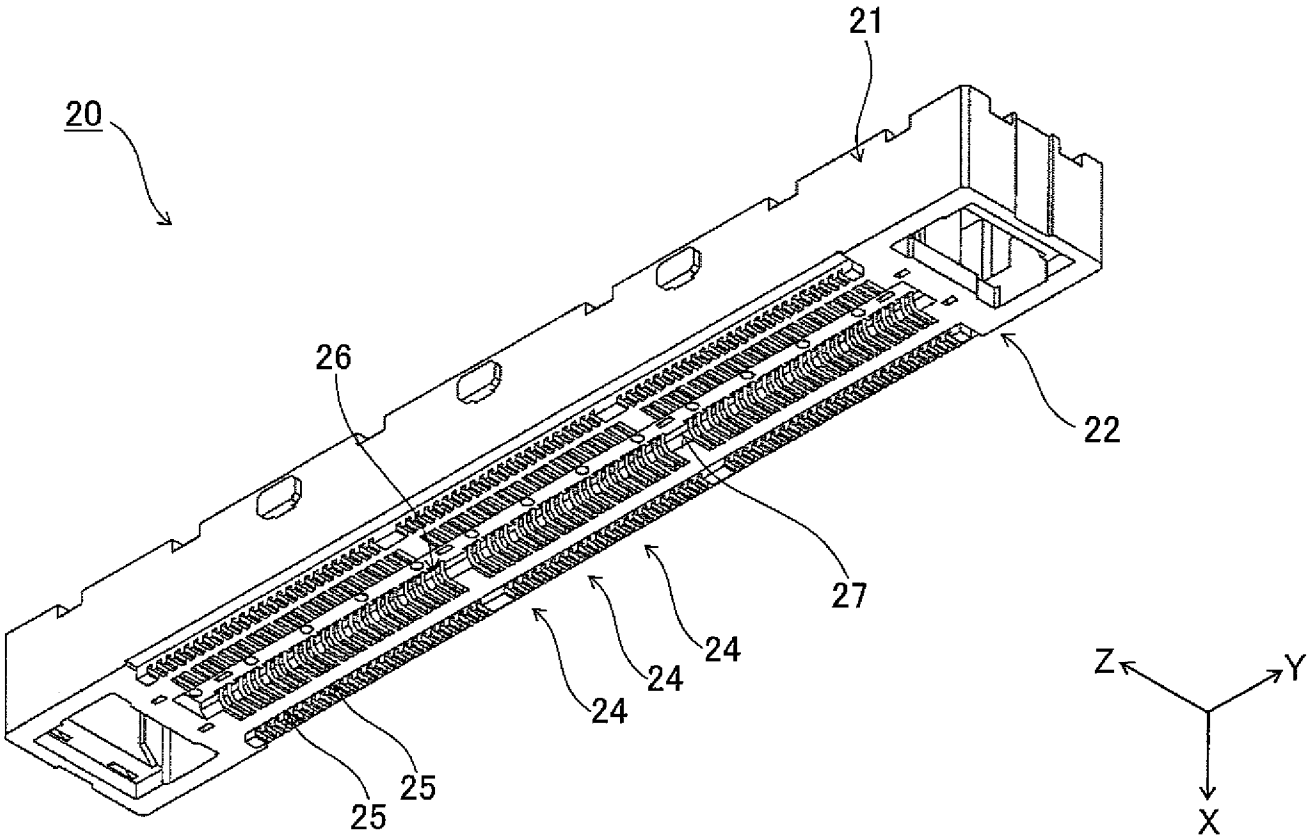
FIG. 5 is a perspective view showing a housing.

The housing 20 is formed of an insulating resin and has, as shown in FIG. 5, a first lateral portion 21 on the side to be fitted with the mating connector 80 and a second lateral portion 22 on the other side opposite to the first lateral portion 21 in the first direction X.

As shown in FIGS. 5 and 10, the housing 20 has a first holding portion 23 formed inside the housing 20 and holding, in a press-fitted state, the contact press-fit portions 17 of the first extending portion 13 of each contact 10, a second holding portion 24 formed on a bottom surface of the housing 20 on the side of the second lateral portion 22 and holding, in a press-fitted state, the contact press-fit portion 17 of the second extending portion 15 of each contact 10, a plurality of contact-receiving groove portions 25 formed on the bottom surface of the housing 20 on the side of the second lateral portion 22 and adapted to receive the contacts 10, third holding portions 26 formed on the bottom surface of the housing 20 on the side of the second lateral portion 22 and holding, in a press-fitted state, holder press-fit portions 33 of the holder member 30, and through-holes 27 penetrating the housing 20 along the first direction X and allowing plate terminal portions 42 of the metal plate 40 to be inserted therethrough.

The holder member 30 is formed of an insulating resin. The holder member 30 is mounted to the housing 20 from the side of the second lateral portion 22 and fixed to the housing 20, as shown in FIG. 3. Herein, one holder member 30 is disposed in common to the two rows of the contacts 10 arranged on the both sides of the housing 20 in the third direction Z, as shown in FIGS. 2 and 10. It is noted here that any number of the holder members 30 may be provided, such as 2 or 3.

Figure 6:
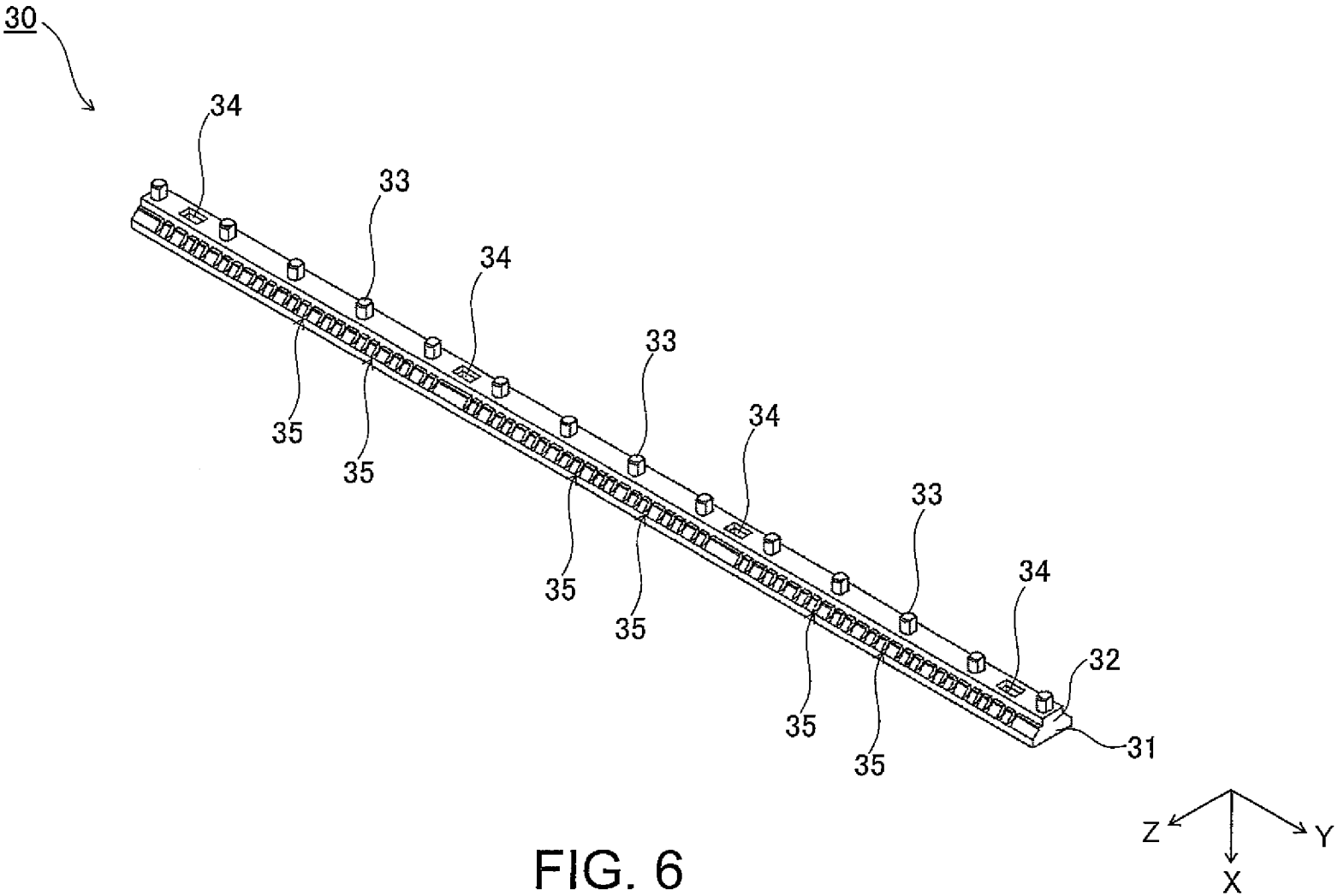
FIG. 6 is a perspective view showing a holder member.

As shown in FIGS. 6 and 10, the holder member 30 has a first holder portion 31 extending along the second direction Y, a second holder portion 32 formed on the first holder portion 31 on the side of the first lateral portion 21, a plurality of holder press-fit portions 33 protruding from an upper surface of the second holder portion 32 on the side of the first lateral portion 21 in the first direction X, a plurality of through-holes 34 formed at the first holder portion 31 and the second holder portion 32 along the first direction X, a plurality of contact-receiving groove portions 35 formed on side surfaces of the first holder portion 31 and the second holder portion 32 and adapted to receive the contacts 10, and the restricting portion 36 formed on an upper surface of the first holder portion 31 on the side of the first lateral portion 21 and adapted to restrict the movement of the contacts 10 toward the second lateral portion 22.

Figure 11:
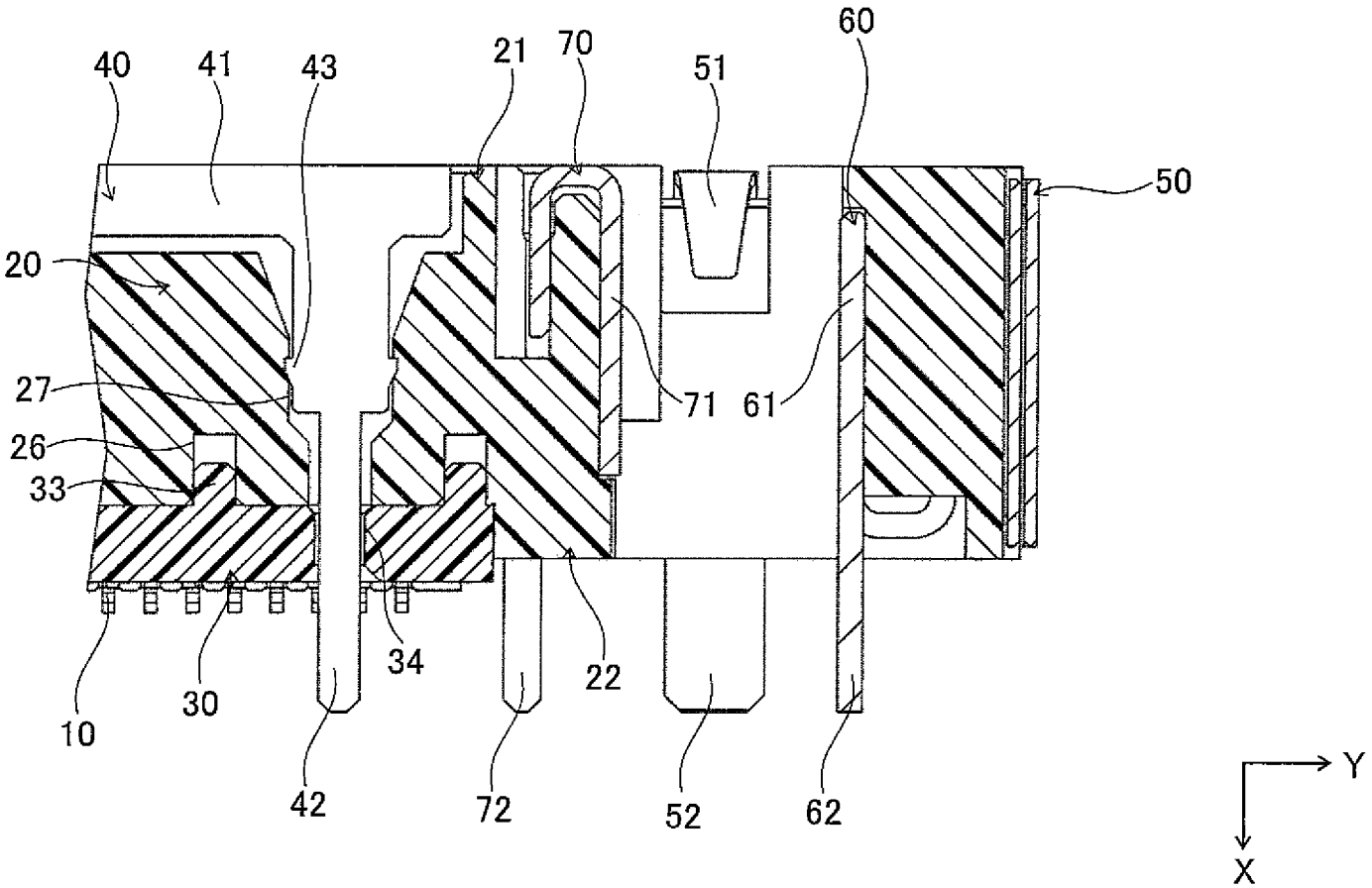
FIG. 11 is a sectional view of the connector taken along a plane defined by a first direction and a second direction.
Figure 12:
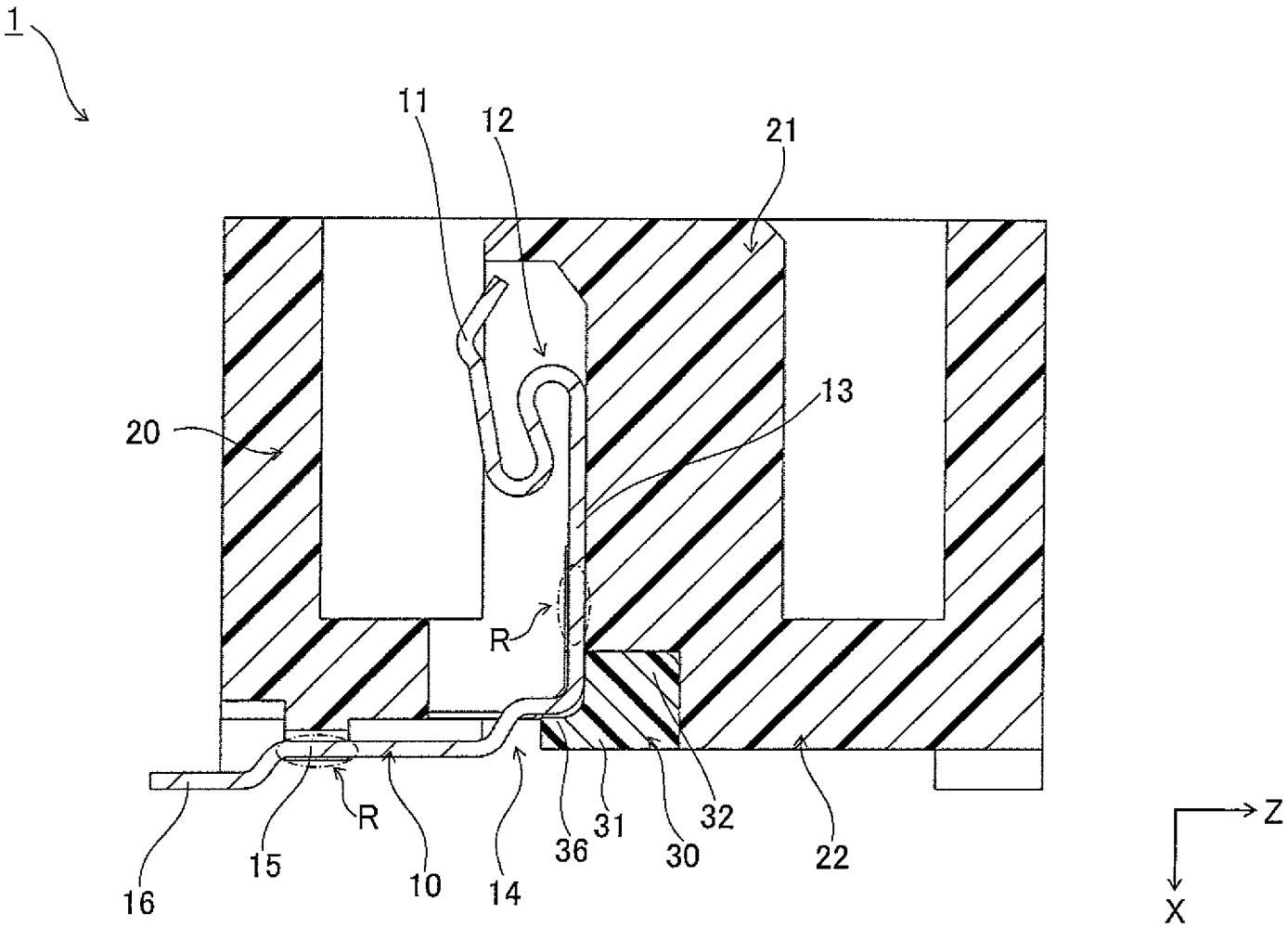
FIG. 12 is a sectional view showing a modification of a mounting state of the contact.

As shown in FIG. 10, the second holder portion 32 is arranged between the first extending portions 13 of the contacts 10 arranged on the both sides of the housing 20 in the third direction Z. With this structure, when the holder member 30 is mounted to the housing 20, the second holder portion 32 is guided by the first extending portions 13 so that the holder member 30 can accurately and easily be mounted to a predetermined position of the housing 20. Further, it is possible to prevent breakage of the holder press-fit portions 33 or the like, which tends to occur in case where the holder member 30 is mounted to the housing 20 at an improper position. The holder press-fit portions 33 are press-fitted into the third holding portions 26 of the housing 20 from the side of the second lateral portion 22, respectively, as shown in FIG. 11. In the present embodiment, the restricting portion 36 is arranged with a space kept from the contact 10, as shown in FIG. 10. However, the restricting portion 36 may be arranged in contact with the contact 10.

The metal plate 40 is an antistatic plate formed of conductive metal. As shown in FIG. 3, the metal plate 40 is inserted into the housing 20 from the side of the first lateral portion 21 along the first direction X and fixed to a predetermined position inside the housing 20.

Figure 7:
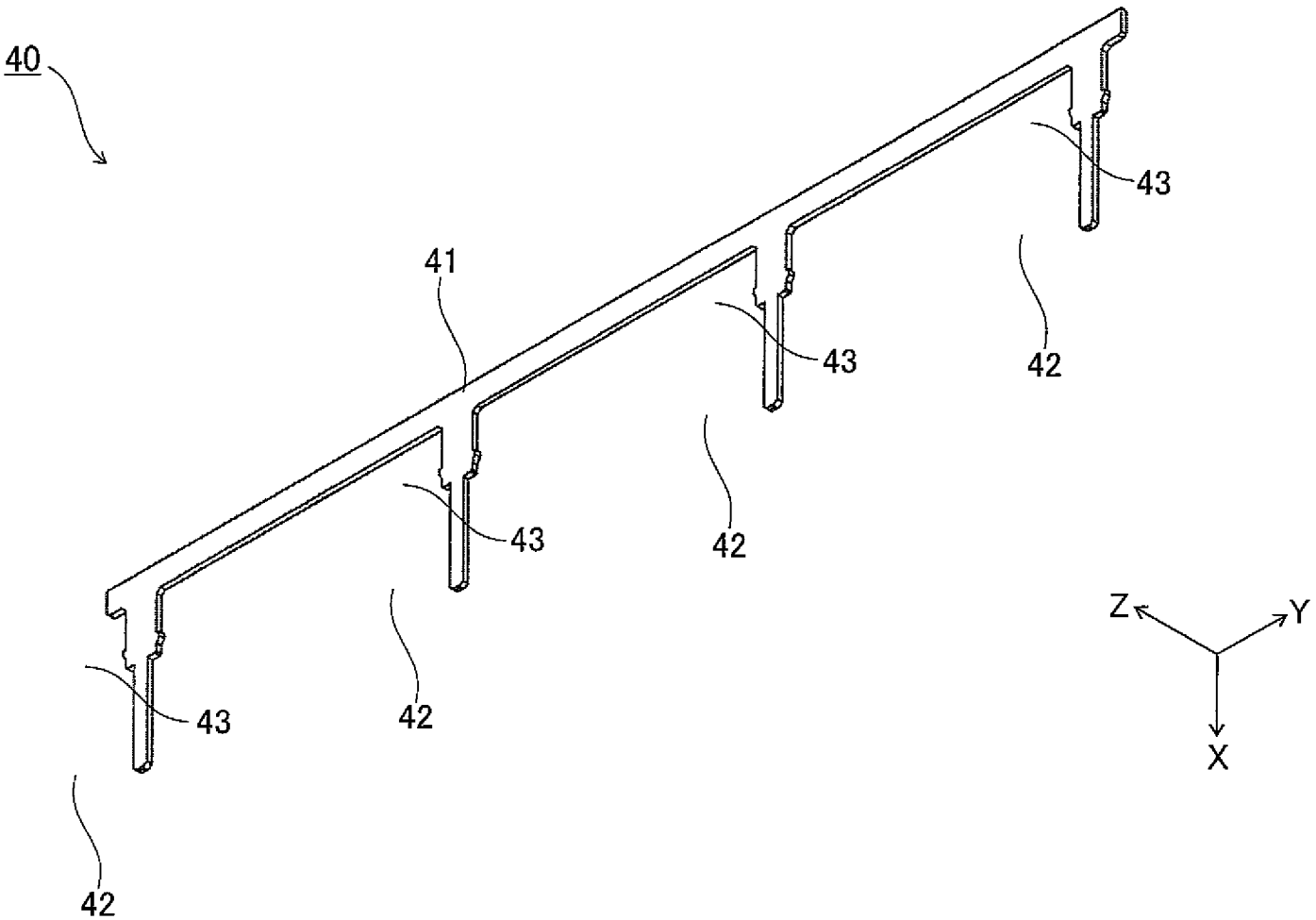
FIG. 7 is a perspective view showing a metal plate.
Figure 8:
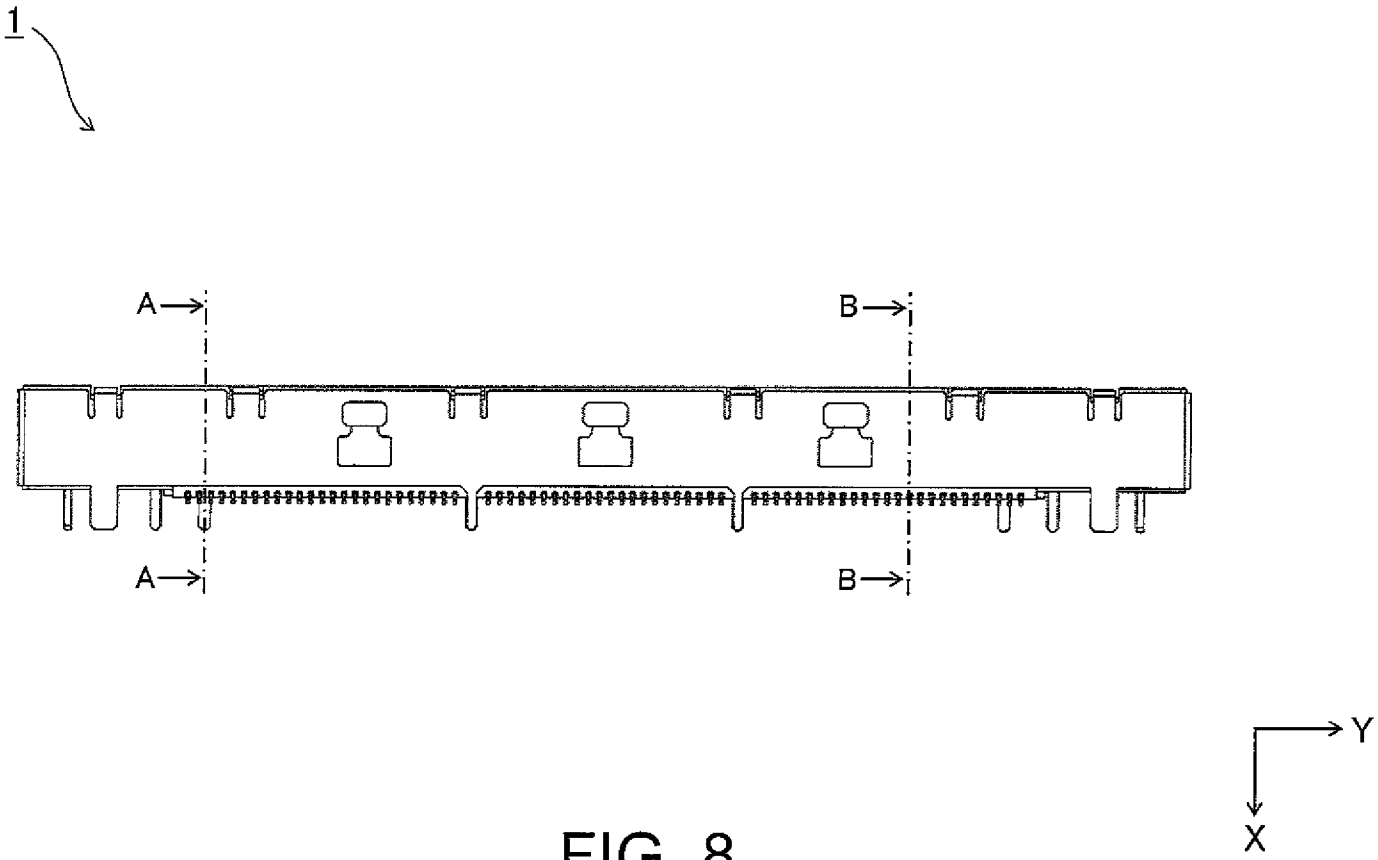
FIG. 8 is a plan view showing the connector.

The metal plate 40 has a plate main body portion 41 extending along the second direction Y and a plurality of plate terminal portions 42 protruding from the plate main body portion 41 along the first direction X toward the second lateral portion 22, as shown in FIG. 7.

By the housing 20, the plate main body portion 41 is restricted from moving toward the second lateral portion 22. As shown in FIG. 2, each of the plate terminal portions 42 is a part protruding toward the second lateral portion 22 and to the outside of the housing 20 to be connected to a substrate (not shown). Each of the plate terminal portions 42 has a plate press-fit portion 43 protruding in the second direction Y and press-fitted into the housing 20, as shown in FIG. 7.

Figure 9:
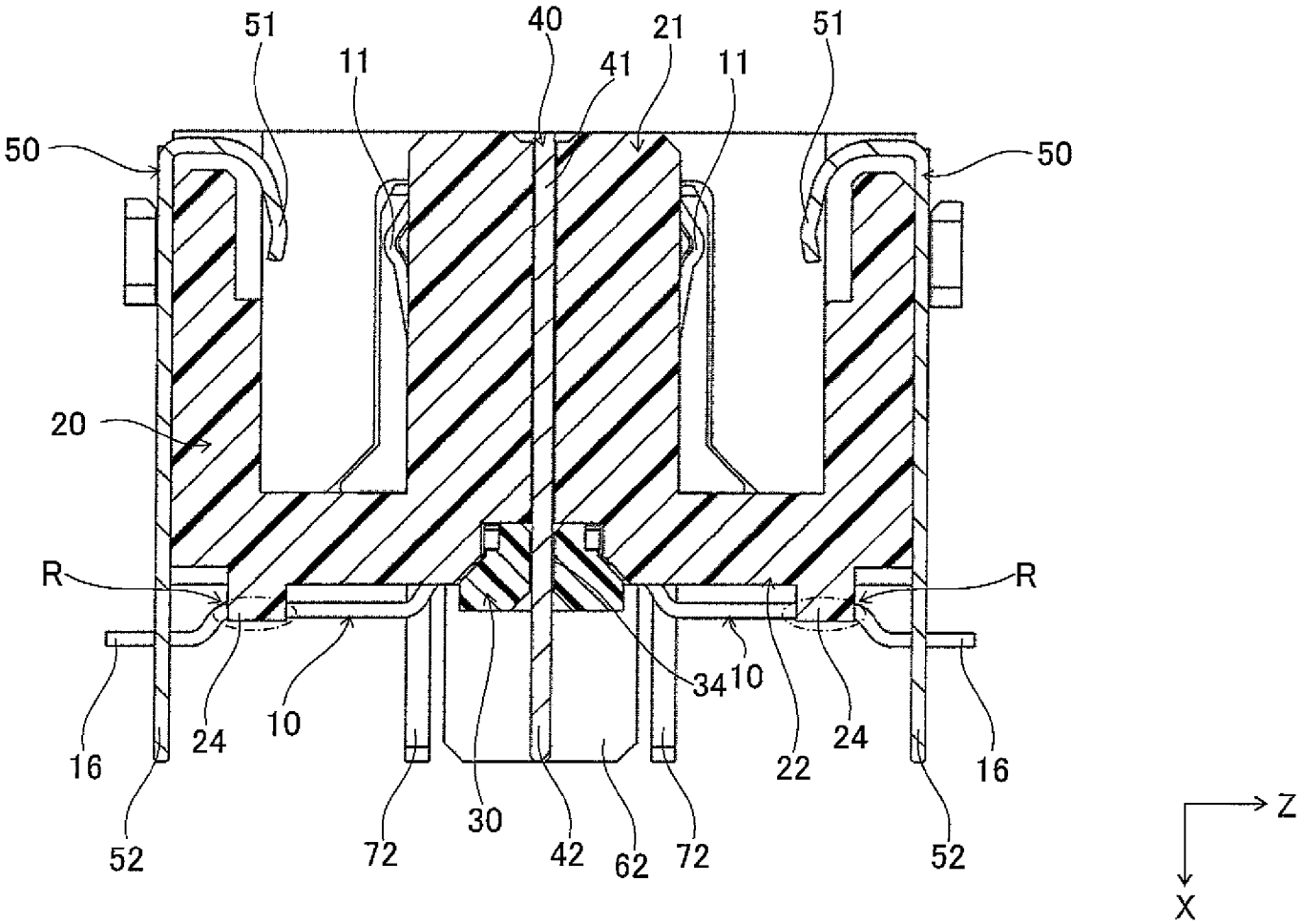
FIG. 9 is a sectional view, taken along a line A-A in FIG. 8, as seen in a direction depicted by arrows.

The plate terminal portions 42 are inserted into the through-holes 34 of the holder member 30, respectively, as shown in FIGS. 9 and 11. With this structure, even when the connector 1 is reduced in size, it is possible to reliably provide insulation between the plate terminal portions 42 and the contacts 10 by using the holder member 30 having a function of holding the contacts 10.

Figure 15:
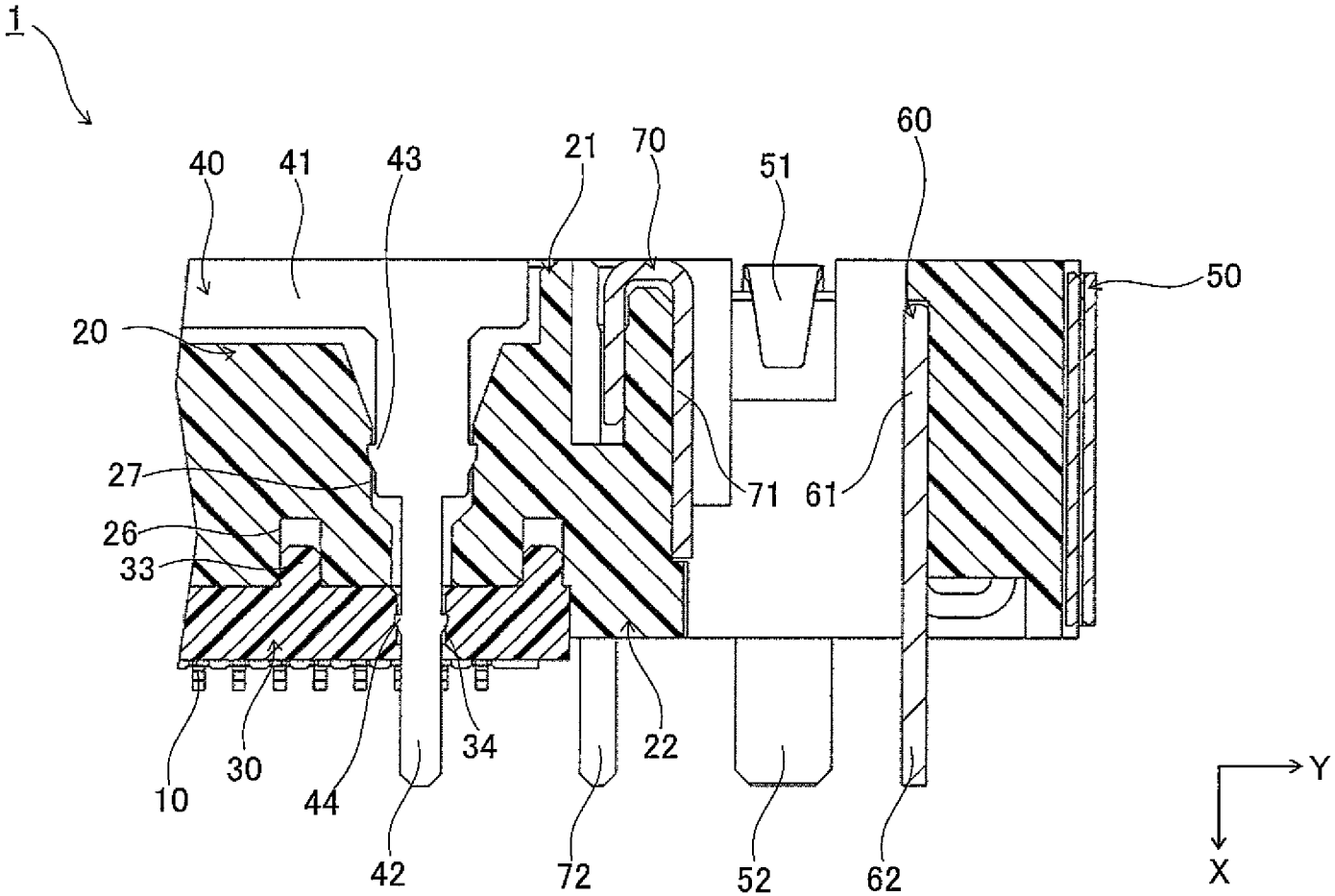
FIG. 15 is a sectional view showing a modification of the metal plate.

As a modification shown in FIG. 15, each of the plate terminal portions 42 of the metal plate 40 may be provided with a second plate press-fit portion 44 to be press-fitted into the through-hole 34 of the holder member 30. In this case, the second plate press-fit portion 44 functions as a holding portion for holding the holder member 30. As described above, the antistatic metal plate 40 also bears the function of holding the holder member 30, thereby improving a holding strength for the holder member 30. Further, without press-fitting the holder member 30 into the housing 20, the holder member 30 may be held by using only press-fitting between the metal plate 40 and the holder member 30, although not shown.

Figure 16:
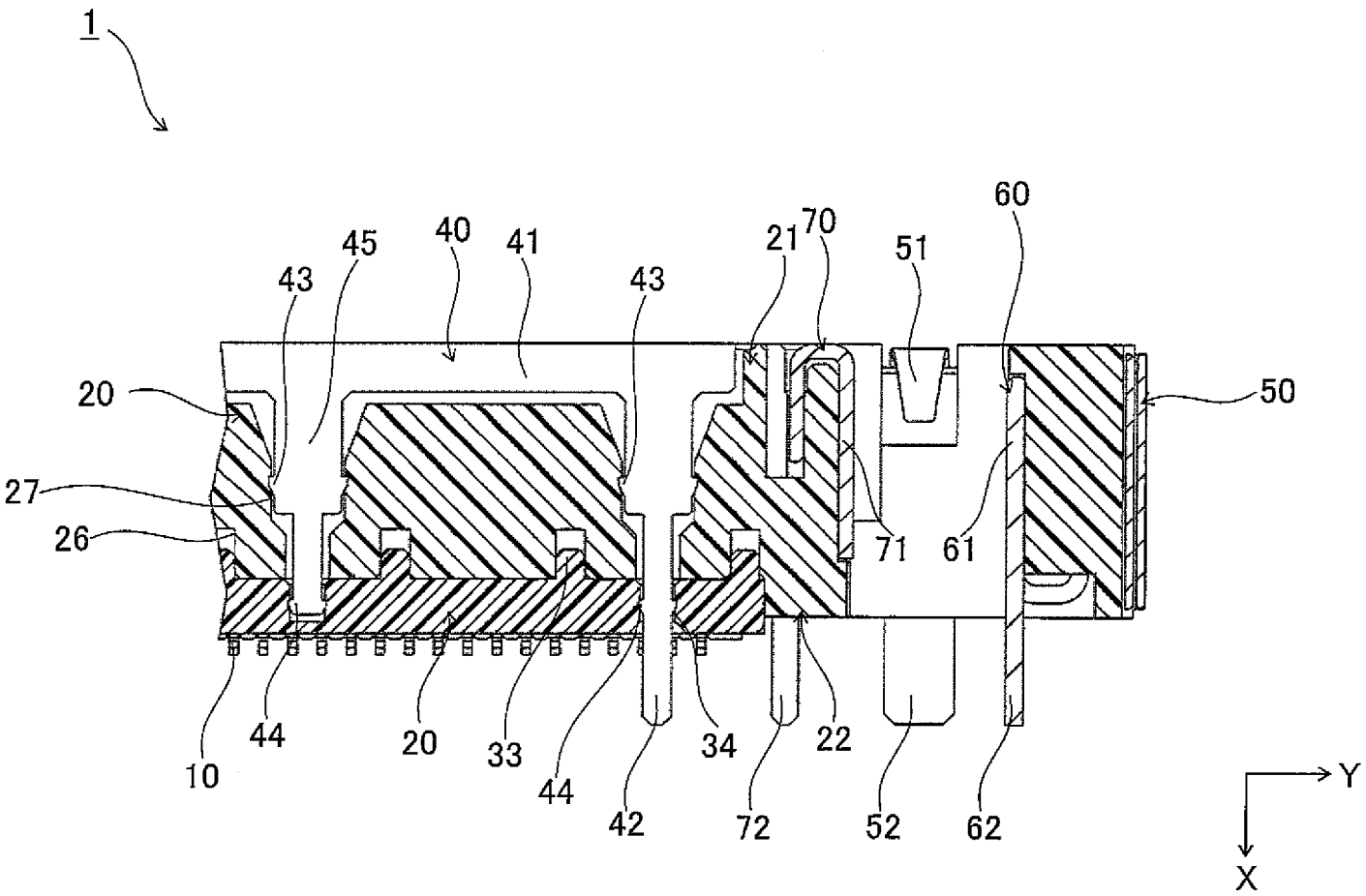
FIG. 16 is a sectional view showing another modification of the metal plate.
Figure 17:
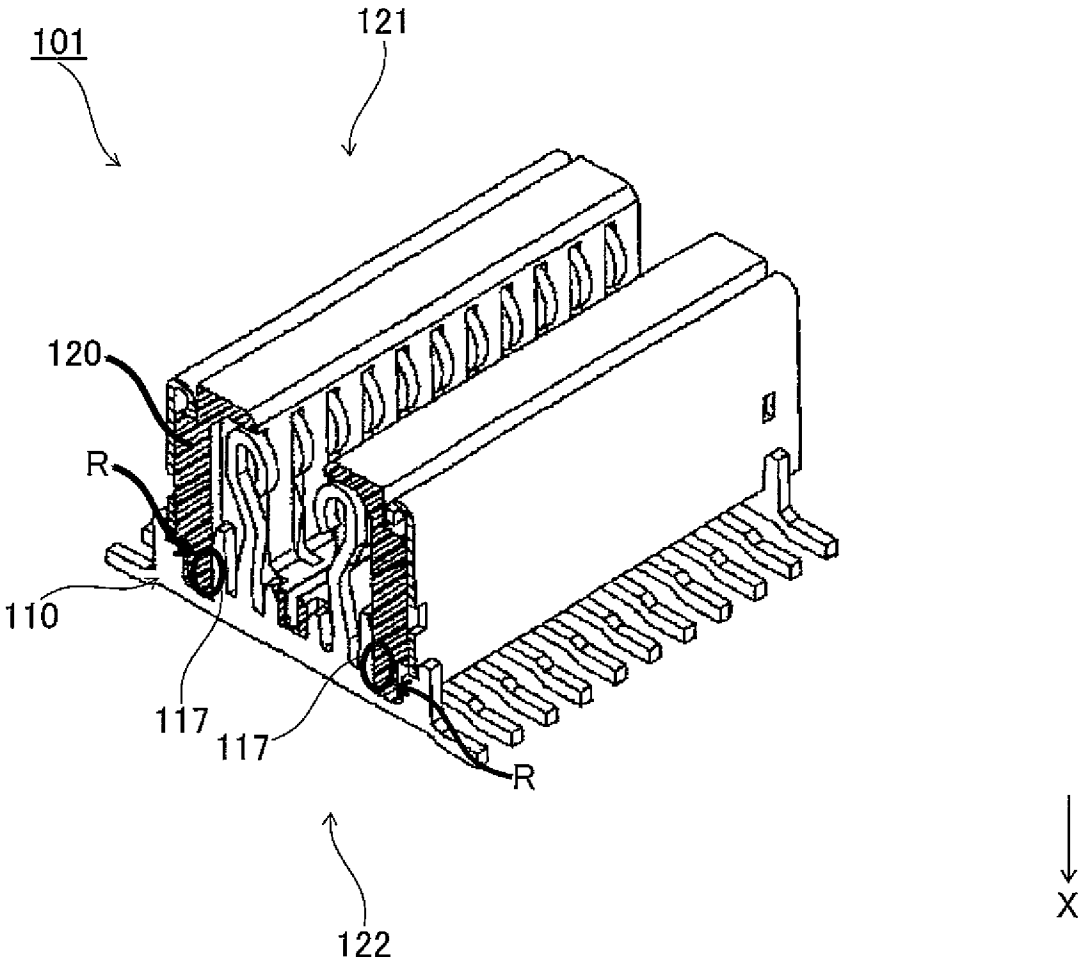
FIG. 17 is a perspective view showing a conventional connector.

Furthermore, as a modification shown in FIG. 16, the metal plate 40 may be provided with a plate extending portion 45 protruding from the plate main body portion 41 along the first direction X. As is different from the plate terminal portion 42, the plate extending portion 45 does not protrude toward the second lateral portion 22 and to the outside of the housing 20. The plate extending portion 45 has the plate press-fit portion 43 press-fitted into the housing 20 and the second plate press-fit portion 44 press-fitted into the holder member 30, as shown in FIG. 16.

The shell 50 is formed of conductive metal and, as shown in FIG. 1, covers four side surfaces of the housing 20, and is fixed to the housing 20. As shown in FIG. 1, the shell 50 has shell contacting portions 51 adapted to be brought into contact with a mating shell (not shown) of the mating connector 80 and shell terminal portions 52 to be connected to the substrate (not shown).

The first power supply contacts 60 are formed of conductive metal and fixed to the housing 20. As shown in FIG. 11, each of the first power supply contacts 60 has a first power supply contacting portion 61 adapted to be brought into contact with a first power supply contact (not shown) of the mating connector 80 and a first power supply terminal portion 62 to be connected to the substrate (not shown).

The second power supply contacts 70 are formed of conductive metal and fixed to the housing 20. As shown in FIG. 11, each of the second power supply contacts 70 has, a second power supply contacting portion 71 adapted to be brought into contact with a second power supply contact (not shown) of the mating connector 80 and a second power supply terminal portion 72 to be connected to the substrate (not shown).

The contact terminal portion 16, the plate terminal portion 42, the shell terminal portion 52, the first power supply terminal portion 62, and the second power supply terminal portion 72 are soldered to the substrate (not shown).

In the foregoing embodiment, the connector 1 is provided with the holder member 30 which has the restricting portion 36 for restricting the movement of the contact 10 toward the second lateral portion 22. Thus, the movement of the contact 10 with respect to the housing 20 is restricted so as to prevent occurrence of loosening at the press-fit part R between the contact 10 and the housing 20. Therefore, even when a sufficiently large size of the press-fit part R between the contact 10 and the housing 20 is not ensured following reduction in size of the connector 1, it is possible to prevent undesired disengagement and misalignment of the contact 10.

What is claimed is:

1. A connector adapted to be fitted with a mating connector in a first direction, which comprises a plurality of contacts arranged with a predetermined pitch in a second direction perpendicular to the first direction, a housing extending in the second direction and holding the contacts, and a holder member extending in the second direction and fixed to the housing, wherein the housing has a first lateral portion on a first side to be fitted with the mating connector and a second lateral portion on a second side opposite to the first lateral portion in the first direction, wherein each of the contacts is press-fitted into the housing from the second side of the second lateral portion, wherein the holder member has a restricting portion which is arranged adjacent to the contacts on the second side of the second lateral portion for restricting the contacts from moving toward the second lateral portion, wherein each of the contacts comprises:

a contacting portion placed on the first side for contacting the mating connector;

a contact terminal portion placed on the second side for external connection;

a first extending portion connected to the contacting portion and extending in the first direction;

a contact press-fit portion formed at the first extending portion; and a second extending portion connected to the contact terminal portion and extending in a third direction perpendicular to the first and the second directions, wherein the contacts further comprise crank portions, respectively, each of the crank portions being formed between the first and the second extending portions, the crank portions being arranged in the second direction to define a recess which is recessed in the second lateral portion from the second side towards the first side, wherein the restricting portion is placed in the recess, and wherein each of the crank portions comprises:

a first portion extending from an extended end of the first extending portion towards the third direction to define a bottom of the recess;

a second portion extending from an extended end of the second extending portion towards the first direction to define a side of the recess and connected to an extended end of the first portion.

2. The connector as claimed in claim 1, wherein the restricting portion extends along the space in the second direction to face at least two of the contacts in the first direction.

3. The connector as claimed in claim 1, comprising a first contact row and a second contact row, wherein the first contact row and the second contact row comprises a plurality of the contacts arranged in the second direction, wherein the first contact row and the second contact row are spaced apart from each other in the third direction, wherein the holder member is provided in common to the first contact row and the second contact row.

4. The connector as claimed in claim 1, further comprising a metal plate arranged inside the housing and having a plate terminal portion for external connection, wherein the holder member is formed of an insulating material and has a through hole allowing the plate terminal portion to be inserted therethrough.

5. The connector as claimed in claim 4, wherein the plate terminal portion has a plate press-fit portion press-fitted into the through hole of the holder member.

6. The connector as claimed in claim 1, further comprising a metal plate arranged inside the housing and having a plate terminal portion for external connection, wherein the metal plate has a holding portion for holding the holder member.

7. The connector as claimed in claim 4, wherein the metal plate is inserted into the housing from the first side of the first lateral portion or the second side of the second lateral portion and mounted to the housing in a state where movement of the metal plate at least in an insertion direction of the metal plate is restricted by the housing, wherein the plate terminal portion is protruding toward the second lateral portion and to an outside portion of the housing.

8. The connector as claimed in claim 4, wherein the metal plate is press-fitted into the housing.

9. The connector as claimed in claim 1, wherein the holder member has a holder press-fit portion press-fitted into the housing from the second side of the second lateral portion.

10. The connector as claimed in claim 1, wherein the contact is a signal contact, wherein the connector further comprises a power supply contact and a shell covering at least a part of the housing.

* * * * *